US005816833A

United States Patent [19]

Hanazaki

[11] Patent Number: 5,816,833

[45] Date of Patent: Oct. 6, 1998

[54] LOW INSERTION FORCE CONNECTOR

[75] Inventor: Hisashi Hanazaki, Shizuoka, Japan

[73] Assignee: Yazaki Corporation, Tokyo, Japan

[21] Appl. No.: 840,696

[22] Filed: Apr. 25, 1997

[30] Foreign Application Priority Data

Apr. 26, 1996 [JP] Japan ..... 8-107602

[51] Int. Cl.[6] ..... H01R 13/62

[52] U.S. Cl. ..... 439/157; 439/347

[58] Field of Search ..... 439/157, 310, 439/347

[56] References Cited

U.S. PATENT DOCUMENTS

| | | | |
|---|---|---|---|
| 4,586,771 | 5/1986 | Kraemer et al. | 439/157 |
| 5,169,327 | 12/1992 | Hatagishi | 439/157 |
| 5,183,408 | 2/1993 | Hatagishi | 439/310 |
| 5,681,175 | 10/1997 | Busse et al. | 439/157 |

FOREIGN PATENT DOCUMENTS

| | | |
|---|---|---|
| 61-203581 | 9/1986 | Japan . |
| 2-123681 | 5/1990 | Japan . |
| 06060933 | 4/1994 | Japan . |

OTHER PUBLICATIONS

European Search Report dated Aug. 26, 1997.

*Primary Examiner*—Neil Abrams
*Assistant Examiner*—T C Patel
*Attorney, Agent, or Firm*—Finnegan, Henderson, Farabow, Garrett & Dunner, L.L.P.

[57] ABSTRACT

In a low insertion force connector in which connector housings are mutually fitted to each other through a fitting guide member, the fitting guide member is constituted by a movable member and an operating member, the movable member being provided with cam slots and a cam follower, the operating member being provided with a driving cam slot for engaging with the cam follower, whereby cam projections formed on one of the connector housings are inserted in and engaged with the cam slots so as to push the operating member in the fitting direction to thereby move the movable member through the cam follower inserted in and engaged with the driving cam slot to make the connector housings fit to each other.

5 Claims, 6 Drawing Sheets

LOW INSERTION FORCE CONNECTOR

BACKGROUND OF THE INVENTION

1. Field of the Invention

The present invention relates to a low insertion force connector in which mutual fitting force between connector housings for use for connection of electric wiring is reduced.

2. Description of the Related Art

In a multipole connector having a large number of built-in terminals, there has been such a problem that a large insertion force is required for mutually fitting connector housings of the connector to thereby make the fitting work difficult.

Then, in order to make the work for fitting connector housings of a connector to each other easy, Japanese Patent Unexamined Publication No. Sho. 61-203581 discloses a connector assembly K in which, as shown in FIG. 8, even in the case of a multipole connector, connector housings of the connector can be easily connected to each other by applying a relatively small insertion force by using the principle of cam.

The connector assembly K is constituted by first and second housings a and b and a cam driven body c. First, the cam driven body c is assembled to the first housing a. Then, the second housing b is fitted to the first housing a as shown in FIG. 9, and the cam driven body c is moved right. As a follower d of the cam driven body c moves in a slot e of the first housing a and a cam track f of the second housing b, the first and second housings a and b are fitted to each other as shown in FIG. 10.

Such a connector assembly K, however, has a disadvantage that a transversely-projected space is required when the cam driven body c is assembled to the first housing a, and a working space for transversely moving the cam driven body c is required for a worker, and that it is necessary to increase the distance of movement, particularly, in the case of expecting a low insertion force, so that a considerably large working space is required in comparison with the size of the first and second housings a and b.

As one means for eliminating the foregoing disadvantage, Japanese Patent Unexamined Publication No. Hei. 2-123681 has proposed a connector assembly K' in which a cam is moved by employing the principle of lever as shown in FIG. 11.

The connector assembly K' is constituted by: a housing member a', provided with a fixing member q and a movable member h; a covering member b'; and a lever arm i having a latch mechanism.

If cam projections m of the covering member b' are engaged into cam recess portions j of the movable member h and notches k of the fixing member q, and the movable member h is horizontally moved, the horizontal movement of the movable member h is converted into vertical movement of the covering member b'. The horizontal movement of the movable member h is performed by turning the lever arm i.

This connector assembly K', however, has a problem that an operation space is required in a place above the covering member b' in order to turn the lever arm i, and it is necessary to provide the operation space so that wires led out from the housing a' and the covering member b' are not interfered with the turn of the lever arm i in the operation space.

SUMMARY OF THE INVENTION

The present invention has been achieved to eliminate the above disadvantages and solve the above problem, and an object of the present invention is to provide a low insertion force connector in which it is possible to facilitate the connector fitting work even in a narrow space, and which is high in the freedom of arrangement of the led-out wires and excellent in the workability in the fitting process.

In order to attain the above object, the present invention provides a low insertion force connector comprising a pair of connector housings to be fitted to each other, a fitting guide member being attached on one of the connector housings, a cam projection being formed on the other of the connector housings, the fitting guide member comprising: a movable member attached on the one connector housing movably in a direction substantially perpendicular to a fitting direction of the connector housings, the movable member being provided with a cam slot and a cam follower; and an operating member attached on the one connector housing movably substantially in the fitting direction, the operating member being provided with a driving cam slot for engaging with the cam follower, wherein the cam projection of the other connector housing is inserted in and engaged with the cam slot of the movable member so as to push the operating member in the fitting direction to thereby move the movable member through the cam follower inserted in and engaged with the driving cam slot to make the connector housings fit to each other.

DETAILED DESCRIPTION OF THE PREFERRED EMBODIMENT

Description will be made below as to an embodiment of the present invention.

Figure 1:
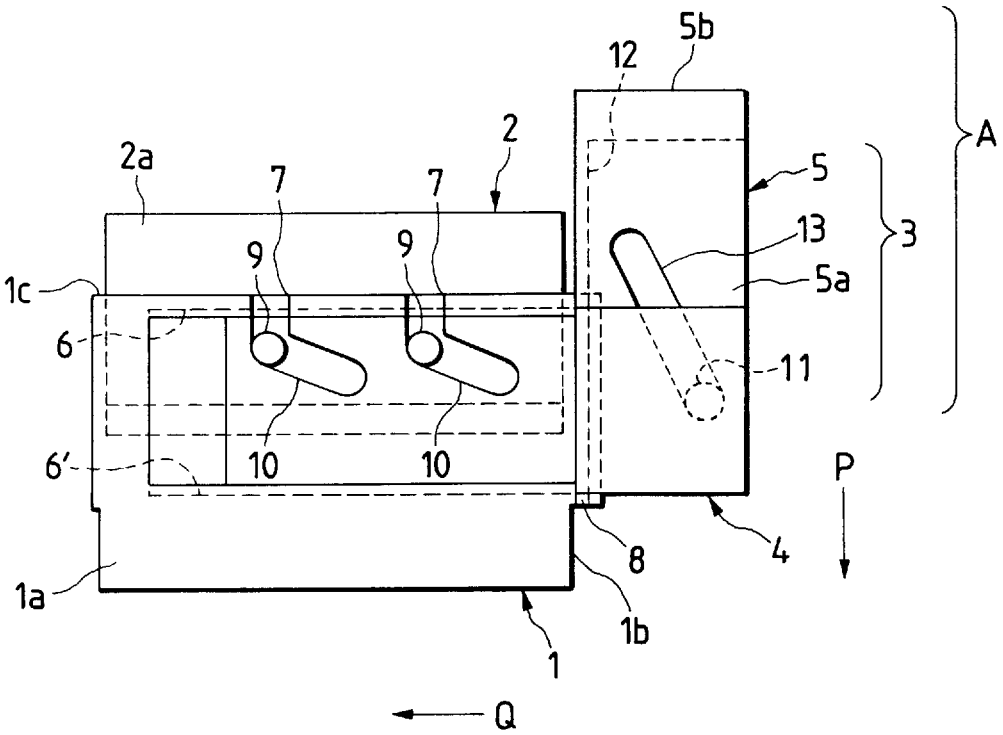
FIG. 1 is a plan view showing an embodiment of the low insertion force connector according to the present invention.
Figure 2:
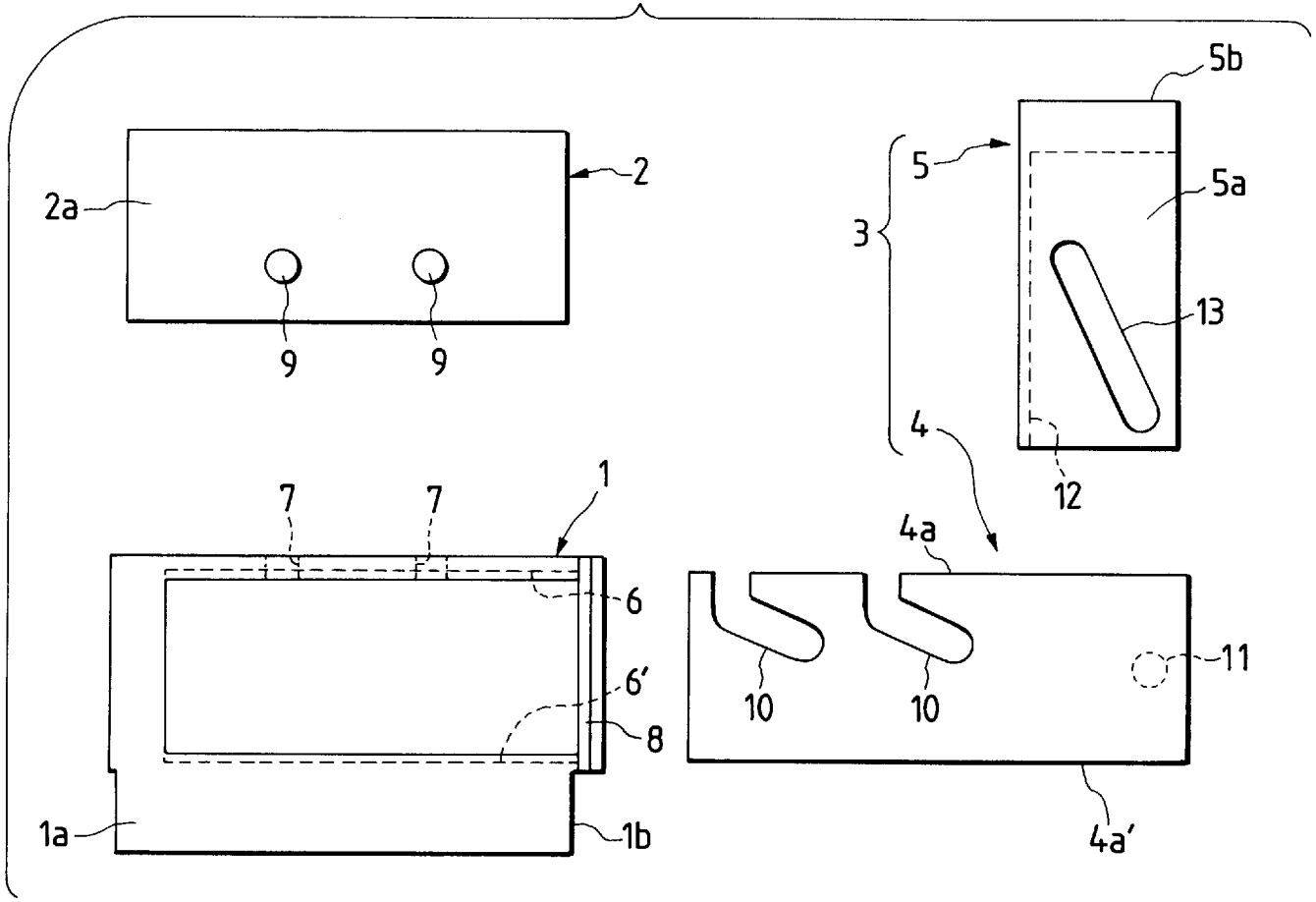
FIG. 2 is an exploded plan view showing the low insertion force connector of FIG. 1.

FIG. 1 is a plan view showing an embodiment of the low insertion force connector A according to the present invention and FIG. 2 is an exploded plan view showing the same embodiment.

The low insertion force connector A includes a pair of connector housings 1 and 2 to be mutually fitted, and a fitting guide member 3 attached to the connector housing 1. The fitting guide member 3 includes a movable member 4 and an operating member 5.

The pair of connector housings 1 and 2 each of which has a plurality of built-in terminal metal fittings (not shown) are configured so that the terminal metal fittings are fitted to each other to perform connection of an electric circuit when the connector housings 1 and 2 are fitted to each other.

Figure 3:
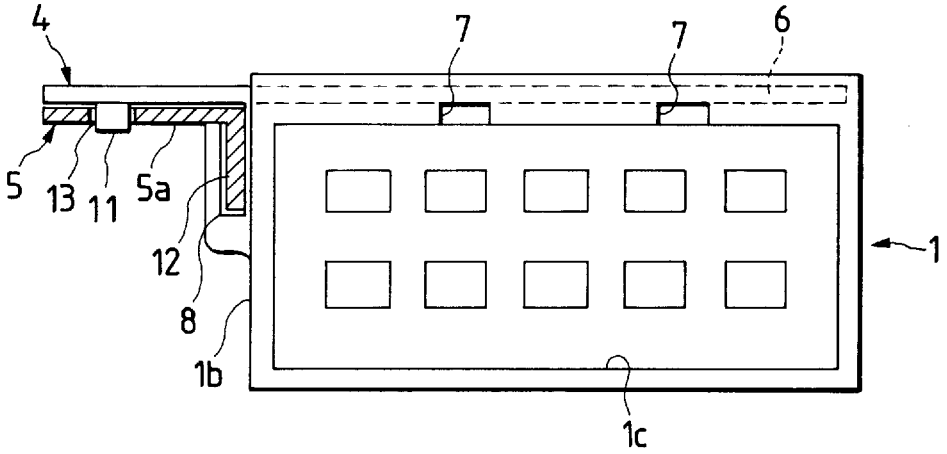
FIG. 3 is a front view showing one connector housing of FIG. 1.

In an outer peripheral wall 1*a* of the connector housing 1, guide grooves 6 and 6' to which the movable member 4 is movably attached are formed so as to extend in the direction substantially perpendicular to the direction for mutually fitting the connector housings 1 and 2 as shown in FIG. 3. Lead-in openings 7 and 7 are formed side by side in the guide groove 6. A guide groove 8 is formed in a side wall 1*b*.

Cam projections 9 and 9 are provided on an outer wall 2*a* of the connector housing 2 at positions corresponding to the lead-in openings 7 and 7 respectively.

The movable member 4 is formed in a strip-like flat plate, and has cam slots 10 and 10 which are engageable with the cam projections 9 and 9 of the connector housing 2 and a cam follower 11 formed at its end portion so as to project downward. By insertion of side edge portions 4*a* and 4*a'* of the movable member 4 into the guide grooves 6 and 6' of the connector housing 1 respectively, the movable member 4 can be attached to the housing connector 1 so as to be movable in the direction substantially perpendicular to the fitting direction.

In the operating member 5, a lead-in projection 12 is provided on a side edge portion of a rectangular base plate portion 5*a* and an operating portion 5*b* is provided on one end of the operating member 5. A driving cam slot 13 is formed in the base plate portion 5*a*. By insertion of the lead-in projection 12 into the guide groove 8 of the connector housing 1 so as to make the cam follower 11 of the movable member 4 engage into the driving cam slot 13, the movable member 4 is made movable along the guide grooves 6 and 6' of the connector housing 1 by the operation of the operating member 5 in the fitting direction.

Next, description will be made as to the operation for fitting the connector housings 1 and 2 to each other.

First, as shown in FIG. 1, the connector housing 2 is fitted into a hood portion 1*c* of the connector housing 1 on which the movable member 4 and the operating member 5 have been attached. At this time, the cam projections 9 and 9 of the connector housing 2 are engaged into the cam slots 10 and 10 of the movable member 4 from the lead-in openings 7 and 7 of the connector housing 1.

Figure 4:
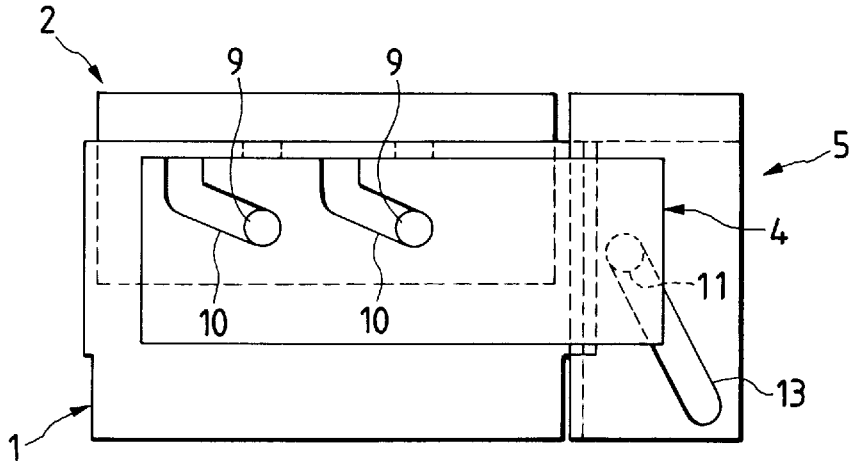
FIG. 4 is a plan view showing a mutually fitted state of the connector housings of FIG. 1.

Then, if the operating portion 5*b* of the operating member 5 is pushed to go ahead in the direction of an arrow P by fingers or the like, the cam follower 11 of the movable member 4 is pressed along the driving cam slot 13 so that the movable member 4 is moved in the direction of an arrow Q. With the movement of the movable member 4 in the direction of the arrow Q, the cam projections 9 and 9 of the connector housing 2 advance along the cam slots 10 and 10 in the fitting direction so that the connector housings 1 and 2 are fitted to each other to complete the fitting as shown in FIG. 4.

Further, when the mutual fitting of the connector housings 1 and 2 is to be released, if the operating member 5 is drawn back in the opposite direction (in the direction opposite to that of the arrow P), the connector housings 1 and 2 can be easily separated from each other.

Figure 5:
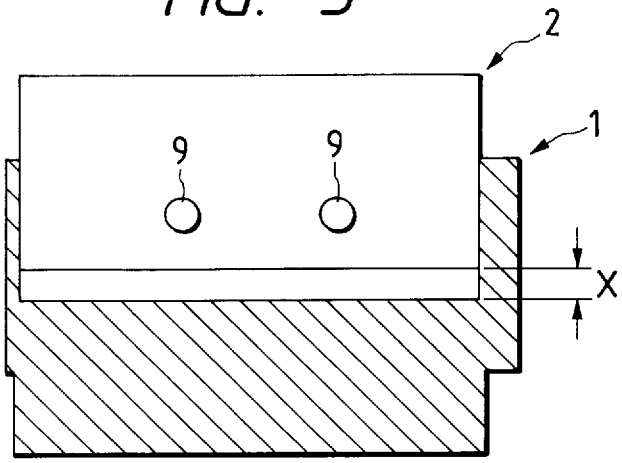
FIG. 5 is a view for explaining the fitting stroke of the connector housings of FIG. 1.
Figure 6:
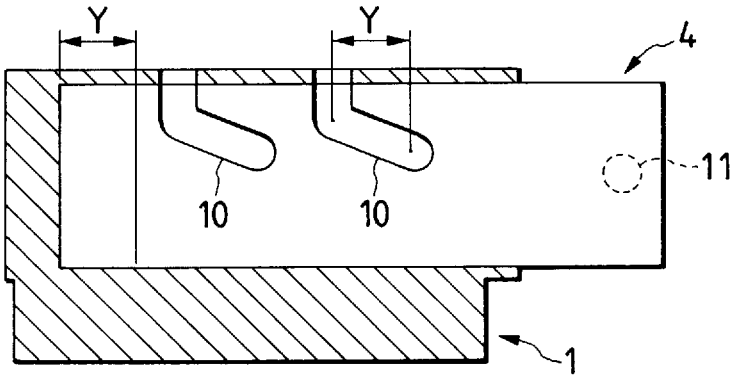
FIG. 6 is a view for explaining the stroke of a movable member of FIG. 1.
Figure 7:
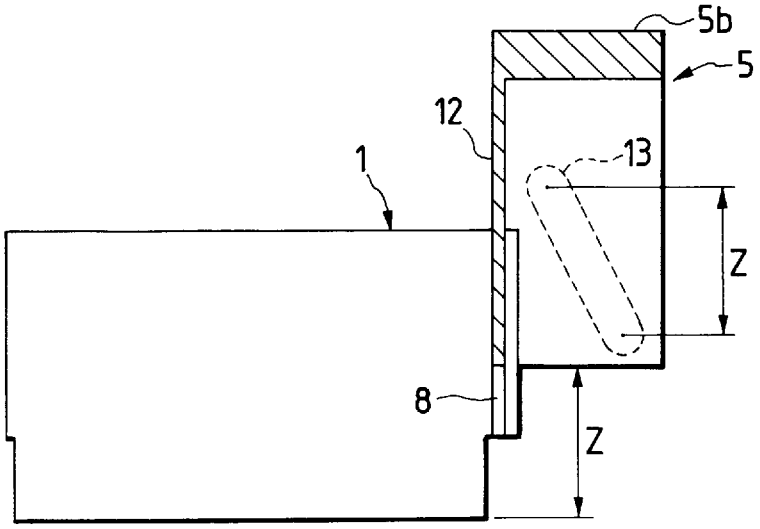
FIG. 7 is a view for explaining the stroke of an operating member of FIG. 1.
Figure 8:
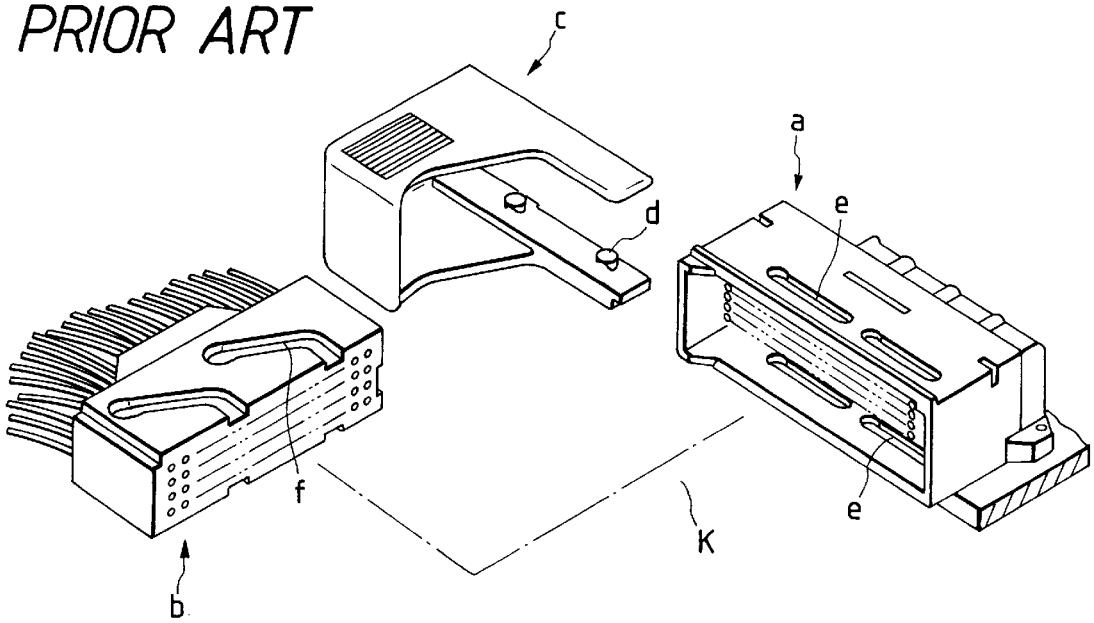
FIG. 8 PRIOR ART
FIG. 8 is an exploded perspective view showing a conventional low insertion force connector assembly.
Figure 9:
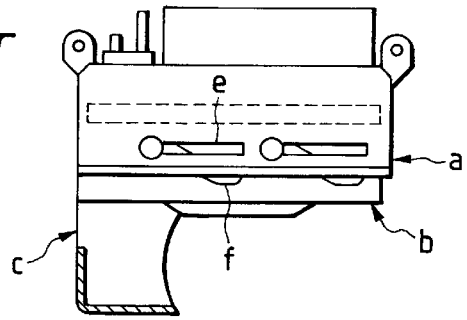
FIG. 9 PRIOR ART
FIG. 9 is a view for explaining an initial state of fitting of the connector assembly of FIG. 8.
Figure 10:
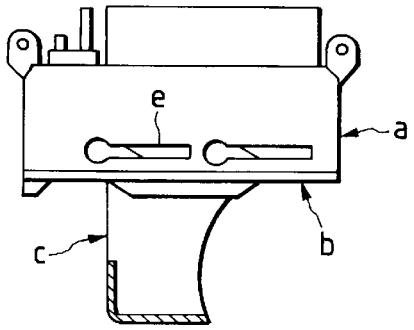
FIG. 10 PRIOR ART
FIG. 10 is a view for explaining a state of completion of the fitting of the connector assembly of FIG. 9.
Figure 11:
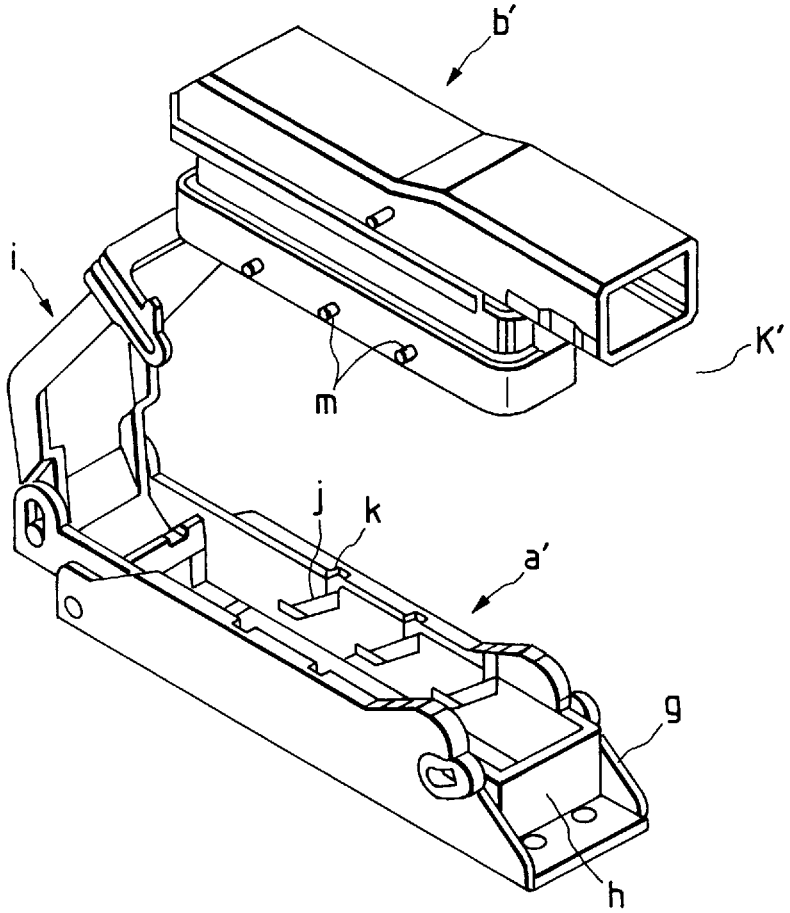
FIG. 11 PRIOR ART
FIG. 11 is a perspective view showing another conventional connector assembly.

When the stroke of the mutual fitting of the connector housings 1 and 2 is represented by X as shown in FIG. 5, the effect of low insertion force by means of the fitting guide member 3 is as follows. As shown in FIGS. 6 and 7, when the stroke of the cam slots 10 and 10 of the movable member 4 is set to Y and the stroke of the driving cam slot 13 of the operating member 5 is set to Z, the operating force to be applied to the movable member 4 is X/Y and the force to be applied to the operating member 5 to move the movable member 4 is Y/Z, with respect to the mutual insertion force of the connector housings 1 and 2.

Therefore, the operating force to be applied to the operating member 5 of the fitting guide member 3 for mutual insertion of the connector housings 1 and 2 is $(X/Y)\times(Y/Z)=X/Z$. That is, the operating force is reduced to a value which is X/Z times as large as the mutual insertion force of the connector housings 1 and 2 per se.

According to the present invention, by the operation to push the operating member of the fitting guide member to go ahead in the fitting direction, the movable member is moved in the direction substantially perpendicular to the fitting direction of the connector housings. Accordingly, no large operation space is required in the periphery of the connector housings, so that the workability in a narrow space as well as the freedom of arrangement of wires led out from the connector housings are improved. Further, the stroke of the cam slot can be set in two stages, that is, the strokes of the movable member and the fitting guide member so that the insertion force can be set to a largely reduced value. Thus, the present invention has many advantages.

What is claimed is:

1. A low insertion force connector comprising a pair of connector housings to be fitted to each other, a fitting guide member being attached on one of said connector housings, a cam projection being formed on the other of said connector housings, said fitting guide member comprising:

a movable member attached on said one connector housing movable in a direction substantially perpendicular to a fitting direction of said connector housings, said movable member being provided with a cam slot and a cam follower; and an operating member attached on said one connector housing and movable substantially in the fitting direction, said operating member being provided with a driving cam slot for slidably engaging with said cam follower, wherein the cam projection of said other connector housing is inserted in and engaged with said cam slot of said movable member such that pushing said operating member in the fitting direction moves said movable member through said cam follower inserted in and engaged with said driving cam slot to make said connector housings fit to each other.

2. The low insertion force connector according to claim 1, wherein a plurality of said cam slots of said movable member and a plurality of said cam projections of said other connector housing are provided side by side respectively.

3. The low insertion force connector according to claim 1, wherein a guide groove to which said movable member is movably attached is formed in said one connector housing so as to extend in the direction substantially perpendicular to the fitting direction.

4. The low insertion force connector according to claim 3, wherein a lead-in opening is formed in said guide groove and said cam projection of said other connector housing is formed at a position corresponding to said lead-in opening.

5. The low insertion force connector according to claim 4, wherein a plurality of said lead-in openings and a plurality of said cam projections are provided side by side respectively.

* * * * *